US008506309B2

(12) United States Patent
Pan et al.

(10) Patent No.: US 8,506,309 B2
(45) Date of Patent: Aug. 13, 2013

(54) ELECTRICAL CONNECTOR WITH IMPROVED SIGNAL TRANSMITTING PERFORMANCE

(75) Inventors: Feng Pan, Kunshan (CN); Chih-Ming Chien, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 81 days.

(21) Appl. No.: 13/225,719

(22) Filed: Sep. 6, 2011

(65) Prior Publication Data

US 2012/0058680 A1 Mar. 8, 2012

(51) Int. Cl.
*H01R 12/00* (2006.01)

(52) U.S. Cl.
USPC ..... 439/78; 439/572

(58) Field of Classification Search
USPC ..... 439/78, 84, 572
See application file for complete search history.

(56) References Cited

U.S. PATENT DOCUMENTS

| | | | | |
|---|---|---|---|---|
| 4,674,812 | A * | 6/1987 | Thom et al. | 439/78 |
| 5,522,730 | A * | 6/1996 | Soes et al. | 439/78 |
| 5,931,686 | A * | 8/1999 | Sasaki et al. | 439/78 |
| 6,254,400 | B1 * | 7/2001 | Yodogawa | 439/78 |

* cited by examiner

*Primary Examiner* — Hien Vu
(74) *Attorney, Agent, or Firm* — Ming Chien Chang; Wei Te Chung

(57) ABSTRACT

An electrical connector (100) includes a middle board (200), a first insulative housing (10) defining a first receiving room (14), a second insulative housing (20) defining a second receiving room (24), and a number of contacts (40) mounted on the first insulative housing. Each of the contacts includes a first mating portion (41) received in the first receiving room and a second mating portion (44) received in the second receiving room. The first mating portion includes a first mating surface (411). The second mating portion includes a second mating surface (421). Each of the contacts includes a twisted portion (43) between the first mating portion and the second mating portion that make the first mating surface perpendicular to the second mating surface.

9 Claims, 11 Drawing Sheets

ELECTRICAL CONNECTOR WITH IMPROVED SIGNAL TRANSMITTING PERFORMANCE

BACKGROUND OF THE INVENTION

1. Field of the Invention

The present invention relates to an electrical connector, and more particularly to an electrical connector for communication applications.

2. Description of Related Arts

In communication applications, a header mated with a receptacle is widely used for transmitting high speed signal. U.S. Pat. No. 5,522,730, issued on Jun. 4, 1996, discloses a header. According to the disclosure, the header connector comprises a middle board, a first insulative housing mounted on a surface of the middle board having an U shape, a second insulative housing mounted on a opposite surface of the middle board having an U shape, and a plurality of contacts mounted on the first and the second insulative housings. The first insulative housing defines a first receiving room, and the second insulative housing defines a second receiving room. Each of the contacts comprises a first mating portion received in the first receiving room and a second mating portion received in the second receiving room. Each of the first mating portions and the second mating portions comprising a pair of smooth surfaces and a pair of rough surfaces perpendicular to the smooth surfaces. Each of the contacts has a straight strip shape so that when the smooth surface of the first mating portion is used for mating with a mating connector, the corresponding second mating portion should use the rough surfaces to mate with a mating connector. The rough surfaces are not suitable for mating with a mating connector to transmit signal.

Hence, an improved electrical connector is desired to offer advantages over the related art.

SUMMARY OF THE INVENTION

An object of the present invention is to provide an electrical connector having contacts with improved signal transmitting performance.

To achieve the above-mentioned object, an electrical connector comprises a middle board defining a plurality of receiving holes, a first insulative housing mounted on a first surface of the middle board and defining a first receiving room having a first opening facing to a first direction, a second insulative housing mounted on an opposite surface of the middle board and defining a second receiving room having a second opening facing to a second direction opposite to the first direction, and a plurality of contacts mounted on the first insulative housing, with each comprising a first mating portion received in the first receiving room and a second mating portion received in the second receiving room. The first mating portion comprises a first mating surface for mating with a first mating connector, and the second mating portion comprises a second mating surface for mating with a second mating connector. Each of the contacts comprises a twisted portion between the first mating portion and the second mating portion that make the first mating surface perpendicular to the second mating surface. The twisted portions are received in the receiving holes respectively According to the present invention, each of the contacts has a twisted portion. Therefore, the smooth surfaces of the first mating portion and the second portion can be used for mating with the first mating connector and the second mating connector at the same time.

DETAILED DESCRIPTION OF THE PREFERRED EMBODIMENT

Reference will now be made in detail to a preferred embodiment of the present invention.

Figure 1:
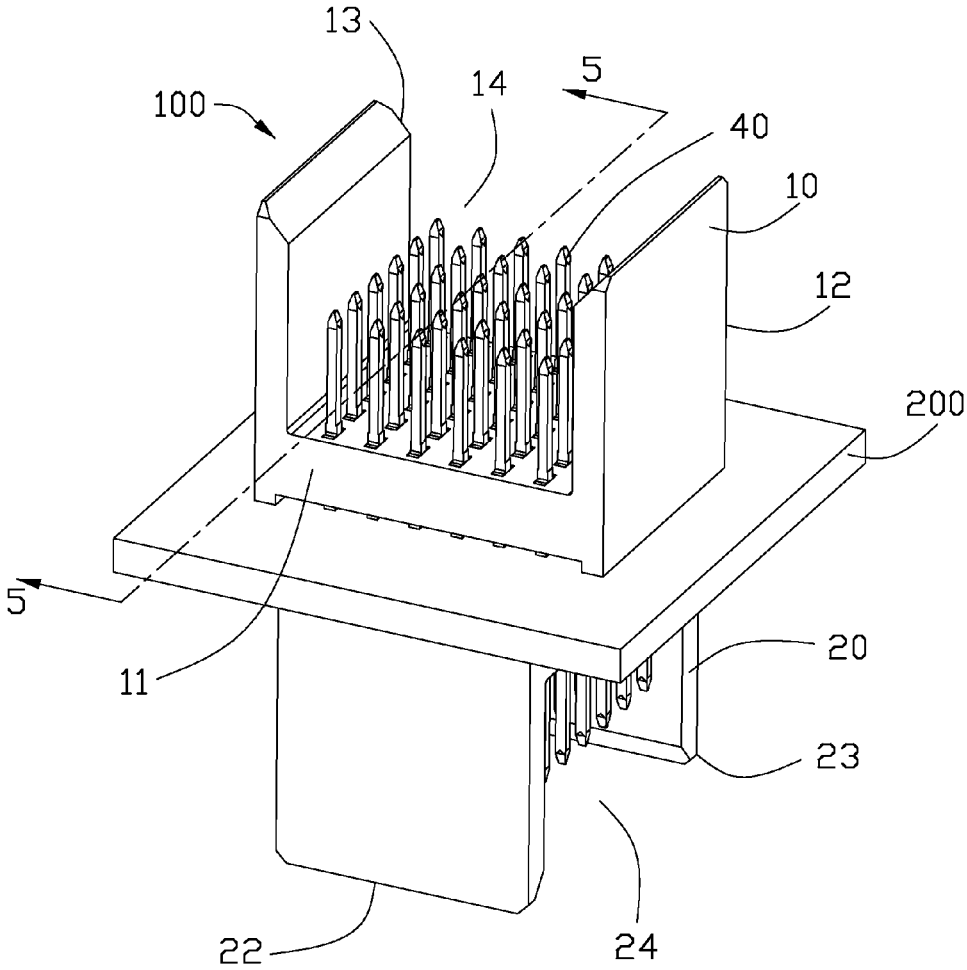
FIG. 1 is a perspective view of an electrical connector in accordance with a first embodiment of the present invention.
Figure 2:
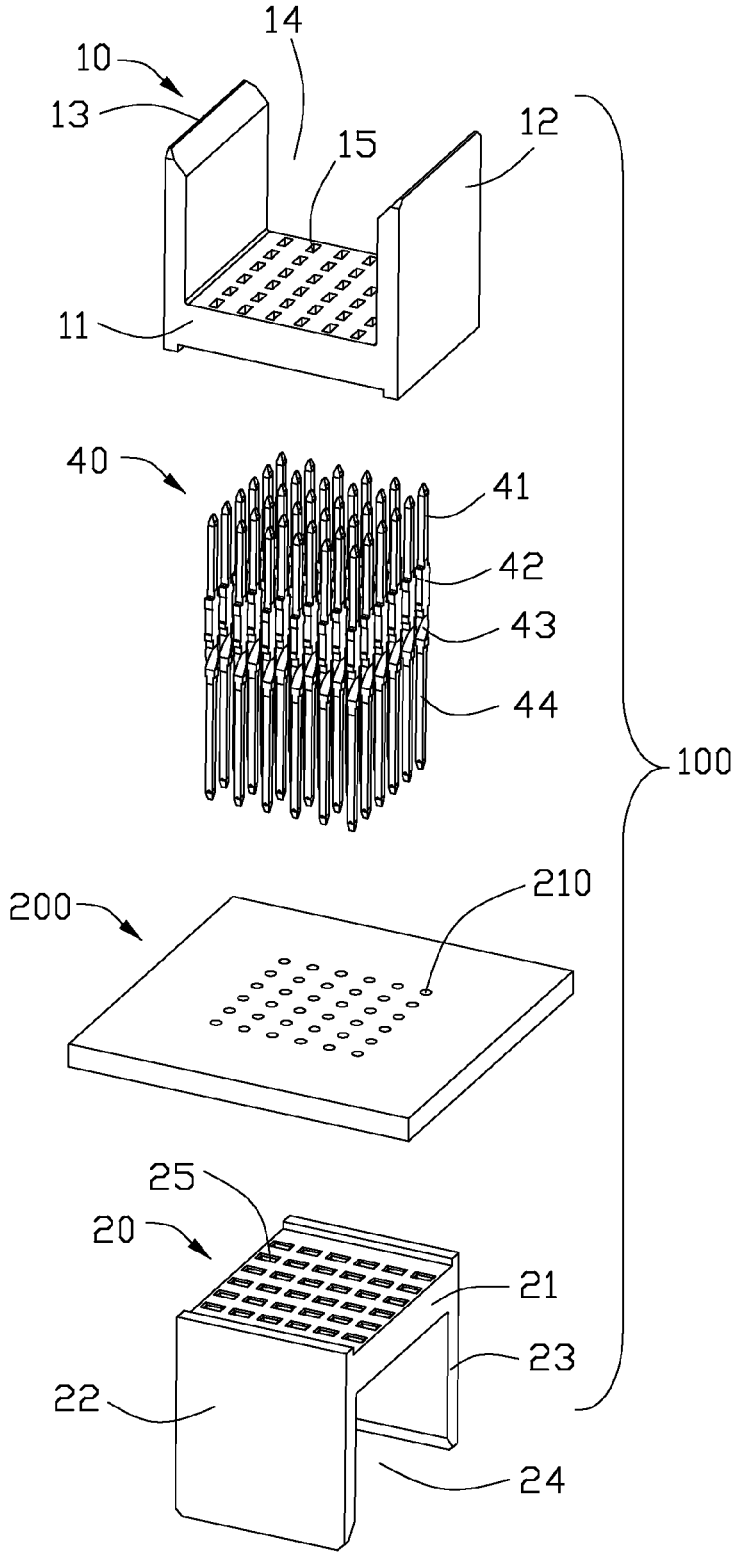
FIG. 2 is an exploded view of the electrical connector as shown in FIG. 1.
Figure 3:
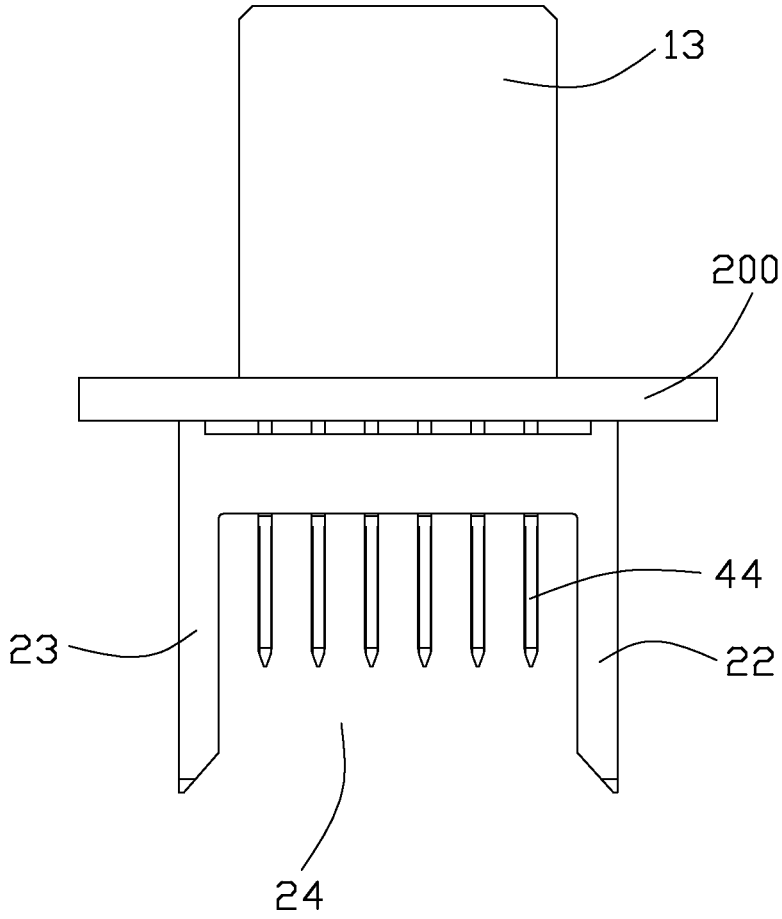
FIG. 3 is a left side view of the electrical connector as shown in FIG. 1.

Referring to FIGS. 1 to 3, an electrical connector 100 in accordance with a first embodiment of the present invention comprises a midplane or middle board 200, a first insulative housing 10 mounted on a first surface of the middle board 200, a second insulative housing 20 mounted on an opposite surface of the middle board 200, and a plurality of contacts 40 mounted on the first insulative housing 10.

Referring to FIG. 2, the first insulative housing 10 having a U shape comprises a first mounting wall 11, a first side wall 12 vertically extending from an edge of the first mounting wall 11 along a first direction, a second side wall 13 vertically extending form an opposite edge of the first mounting wall 11 along the first direction, and a first receiving room 14 defined between the first and the second side walls 12, 13 for receiving a first mating connector. The first mounting wall 11 comprises a plurality of first mounting holes 15 extending through the first mounting wall 11.

The second insulative housing 20 having a structure similar to the first insulative housing 10 comprises a second mounting wall 21 parallel to the first mounting wall 11, a third side wall 22 vertically extending from an edge of the second mounting wall 21 along a second direction opposite to the first direction, a fourth side wall 23 vertically extending from an opposite edge of the second mounting wall 21 along the second direction, and a second receiving room 24 defined between the third side wall 22 and the fourth side wall 23 for receiving a second mating connector. The first receiving room 14 has a first opening facing to the first direction, and the second receiving room 24 has a second opening facing to a second direction. The second mounting wall 21 comprises a plurality of second mounting holes 25 extending through the second mounting wall 21.

The middle board 200 is disposed between the first mounting wall 11 and the second mounting wall 21 and defines a plurality of receiving hole 210 extending through the middle board 200 for receiving the contacts 40.

Figure 4:
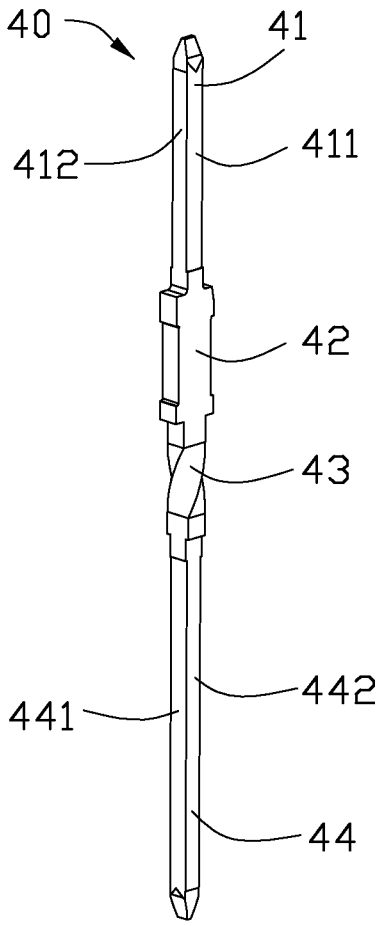
FIG. 4 is a perspective view of a contact of the electrical connector as shown in FIG. 1.
Figure 5:
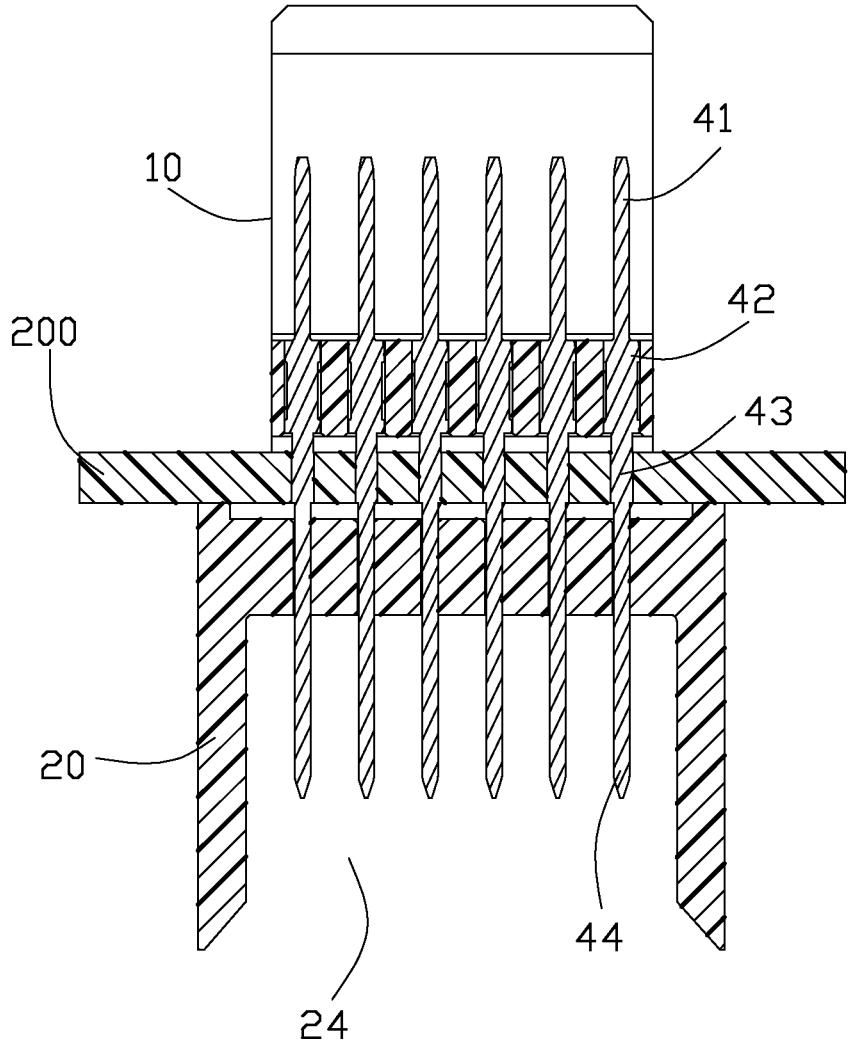
FIG. 5 is a cross-sectional view of the electrical connector taken along line 5-5 of FIG. 1.

Referring to FIGS. 4 and 5, each of the contacts 40 having a straight strip shape comprises a first mating portion 41 received in the first receiving room 14, a second mating portion 44 received in the second receiving room 24, a twisted portion 43 between the first mating portion 41 and the second mating portion 42, and a mounting portion 42 connecting between the first mating portion 41 and the twisted portion 43. The twisted portions 43 are disposed between the first mounting wall 11 and the second mounting wall 21, and are received in the receiving holes 210 of the middle board 200, respectively. The mounting portions 42 are received in the first mounting holes 15 of the first mounting wall 11, respectively, to securely assemble the contacts 40 to the first insulative housing 10. The first and the second mating portions 41, 44 have a first width, and the mounting portions 42 have a second width larger than the first width. The first mating portion 41 extends from the mounting portion 42 along the first direction, and the second mating portion 44 extends from the twisted portions 43 along the second direction.

Each of the first mating portions 41 comprises a first mating surface 411 for electrically connecting with the first mating connector and a pair of first cut surfaces 412 perpendicular to the first mating surface 411. Each of the second mating portions 44 comprises a second mating surface 441 for electrically connecting with the second mating connector and a pair of second cut surfaces 442 perpendicular to the second mating surface 441. The first mating surface 411 comprises a first surface and a second surface opposite and parallel to the first surface, and the pair of first cut surfaces 412 connecting between the first surface and the second surface. The second mating surface 441 comprises a third surface and a fourth surface opposite and parallel to the third surface, and the pair of second cut surfaces 442 connecting between the third surface and the fourth surface. Each of the twisted portions 43 is turned 90 degree to make the first mating surface 411 perpendicular to the second mating surface 441. The first mating surface 411 and the second surface 441 are disposed in a common planar plane before the twisted portion 43 formed in a contact strip. The first and the second mating surfaces 411, 441 are formed by smooth surfaces of the contact strip having a surface roughness smaller than a surface roughness of the first and the second cut surfaces 412, 442 of the contact strip. The electrical connection performance is improved between the connector 100 and the first and the second mating connectors.

Figure 6:
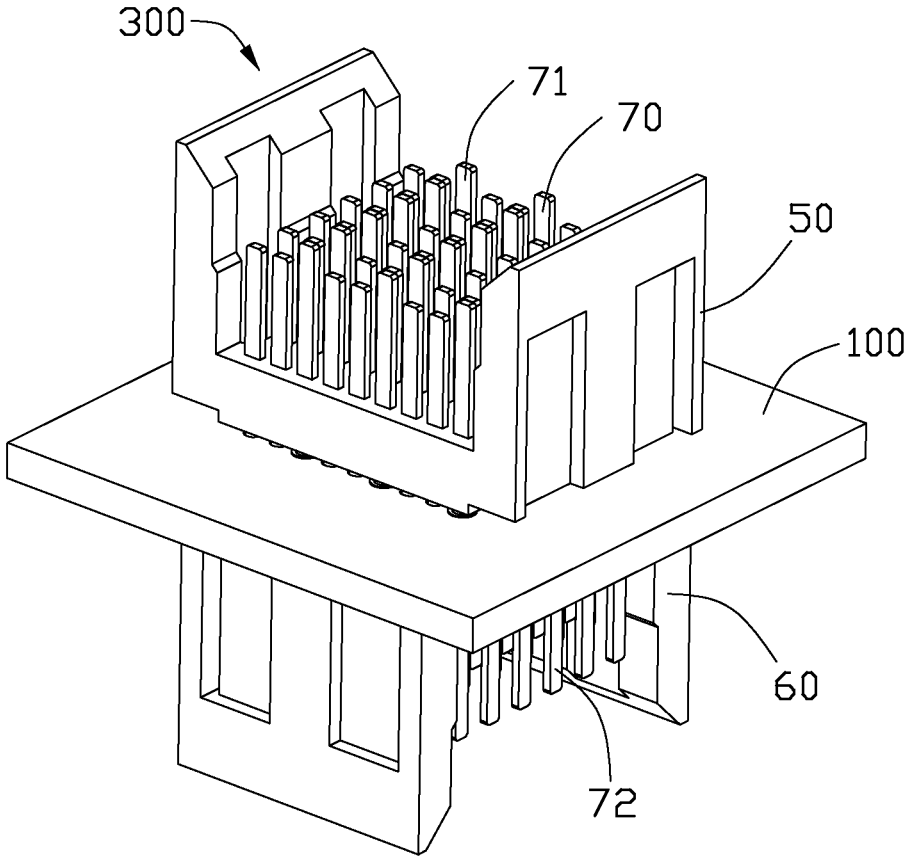
FIG. 6 is a perspective view of an electrical connector in accordance with a second embodiment of the present invention.
Figure 7:
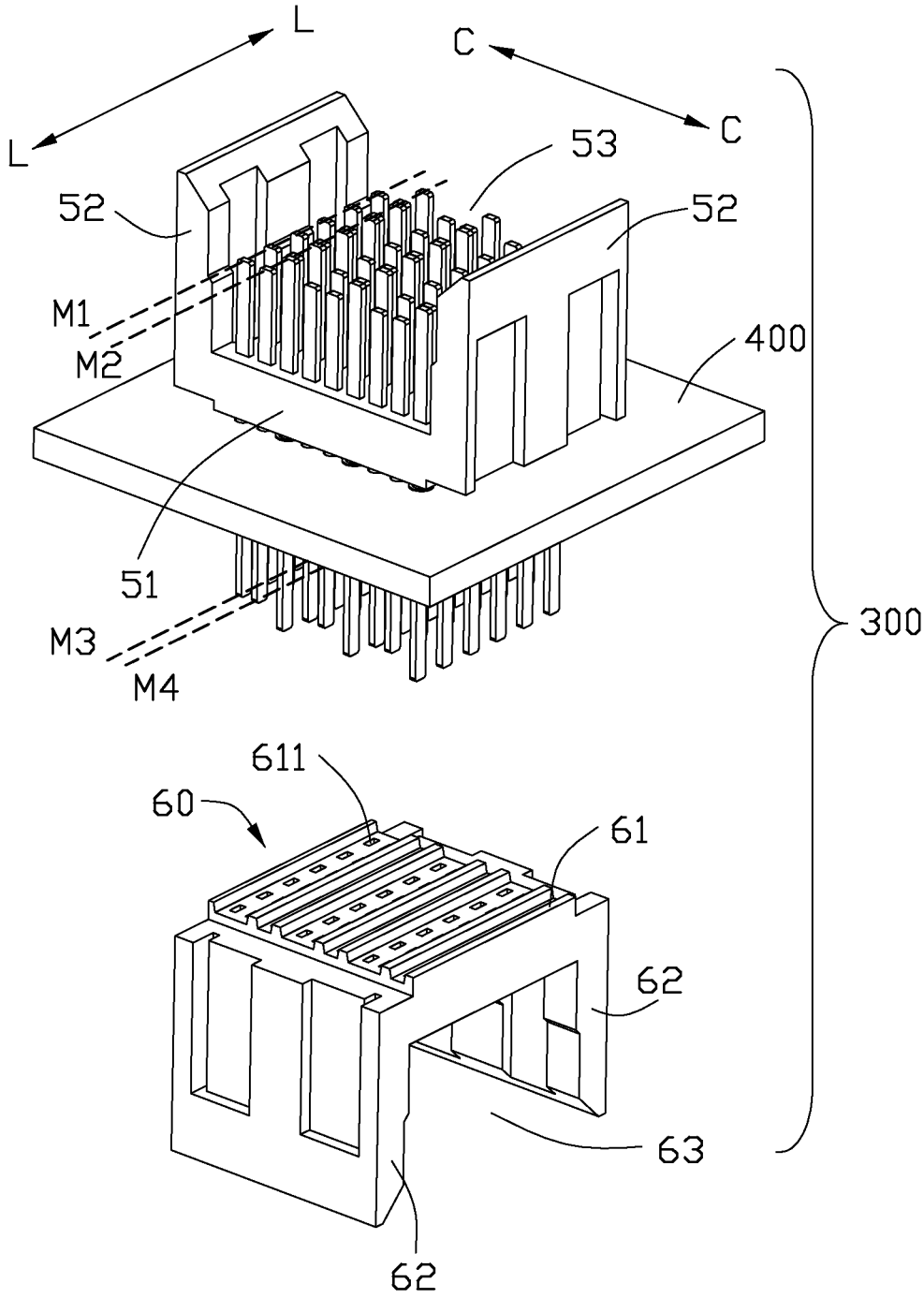
FIG. 7 is a partly exploded view of the electrical connector as shown in FIG. 6 showing the second insulative housing separated apart from the middle board.

Referring to FIGS. 6 and 7, an electrical connector 300 in accordance with a second embodiment of the present invention comprises a midplane or middle board 400, a first insulative housing 50 mounted on a first surface of the middle board 400, and a second insulative housing 60 mounted on an opposite surface of the middle board 400, and a plurality of contacts 70 mounted on the first insulative housing 50 and the second insulative housing 60.

The first insulative housing 50 having a U shape comprises a first mounting wall 51, a pair of first side walls 52 vertically extending form an opposite ends of the first mounting wall 51 respectively along a first direction, and a first receiving room 53 defined between the pair of the first side walls 52. The first mounting wall 51 defines a plurality of first mounting holes 511 extending through the first mounting wall 51. The first side walls 52 are parallel to each other.

The second insulative housing 60 having a structure similar to the first insulative housing 50, comprises a second mounting wall 61 parallel to the first mounting wall 51, a pair of second side walls 62 vertically extending from opposite ends of the second mounting wall 61 respectively along a second direction opposite to the first direction, and a second receiving room 63 defined between the pair of the second side walls 62 for receiving a second mating connector. The second mounting wall 61 comprises a plurality of second mounting holes 611. The pair of second side walls 62 are parallel to each other.

The middle board 400 is disposed between the first mounting wall 51 and the second mounting wall 61. The middle board 400 comprises a plurality of receiving holes 410, 420. Some of the receiving holes 410 have an insulative inner surface, and the others of the receiving holes 120 have a conductive inner surface. The contacts 70 can extend through the receiving holes 410, 420.

Each of the contacts 70 comprises a first mating portion 71 received in the first receiving room 53, a second mating portion 72 received in the second receiving room 63, a twisted portion 73 disposed between the first mating portion 71 and the second mating portion 72. The twisted portion 73 is turned 90 degree. The first mating portions 71 extend through the corresponding first mounting holes 510 to be received in the first receiving room 53, and the second mating portions 72 extend through the corresponding second mounting holes 610 to be received in the second receiving room 63. The twisted portions 73 are disposed between the first mounting wall 51 and the second mounting wall 61, and extend beyond the first and the second mounting walls 51, 61. The twisted portions 73 are received in the receiving holes 410, 420 of the middle board 400.

Figure 9:
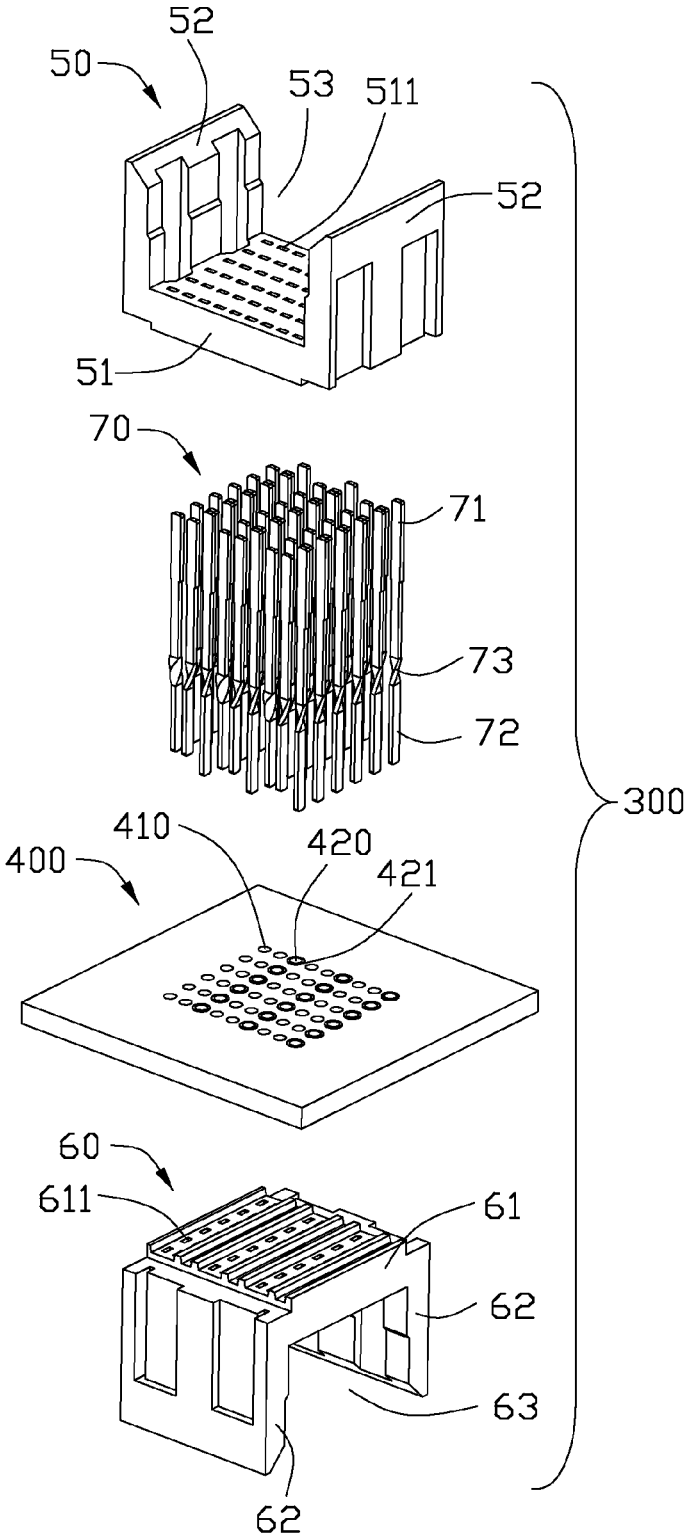
FIG. 9 is an exploded view of the electrical connector as shown in FIG. 6.
Figure 10:
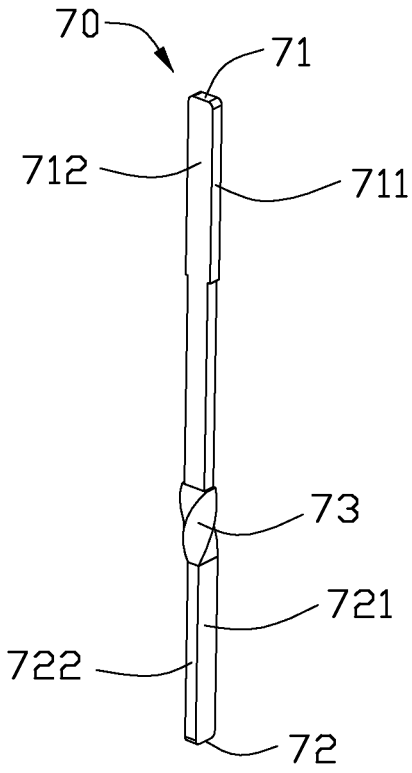
FIG. 10 is a perspective view of a contact as shown in FIG. 6.
Figure 11:
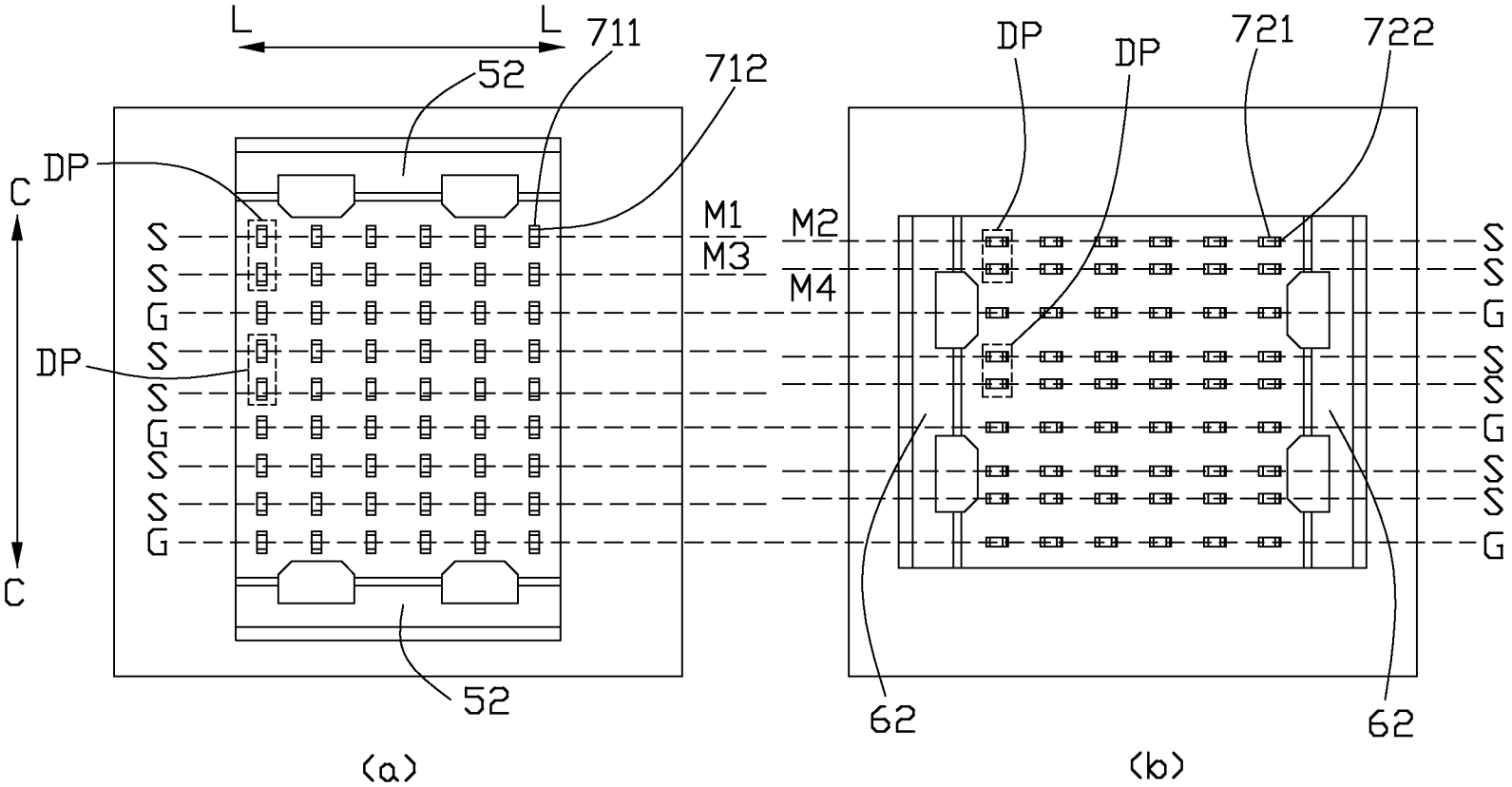
FIG. 11 is a top view of the electrical connector compared with a bottom view of the electrical connector as shown in FIG. 6.

Referring to FIGS. 9 and 11, the contacts 70 being arranged in matrix comprise a plurality of signal contacts S and a plurality of grounding contacts G. All of the signal contacts S are arranged in a plurality of rows along a L-L direction, and the all of the grounding contacts G are arranged in a plurality of rows along the L-L direction. The signal contacts S and the grounding contacts G are arranged in SSGSSGSSG in a C-C direction perpendicular to the L-L direction.

Referring to FIG. 11 (*a*), the signal contacts S have a structure similar to the grounding contacts G. Each of the first mating portions 71 comprises a pair of first edges 711 parallel to the L-L direction, and a pair of first broad sides 712 perpendicular to the first edges 711. The first broad sides 712 have a width larger than a width of the first edges 711. Referring to FIG. 11 (*b*), each of the second mating portions 72 comprises a pair of second broad sides 721 parallel to the L-L direction, and a pair of second edges 722 perpendicular to the second broad sides 721. The second broad sides 721 have a width larger than a width of the second edges 722.

When the electrical connector 300 is mated with the first and the second mating connectors, the first edges 711 of the first mating portions 71 are used as contact surfaces for mating with the first mating connector to make an edge coupled between the first mating portion 51 and the first mating connector, and the second broad sides 721 of the second mating portions 72 are used as a contact surface for mating with the second mating connector to make a broadside coupled between the second mating portions 61 and the second mating connector.

Referring to FIGS. 11 (*a*) and 11 (*b*), the first mating portions 71 of one row of the signal contacts S have a first imaginary central line M1 parallel to the L-L direction, and the second mating portions 72 of the row of the signal contacts S have a second imaginary central line M2 parallel to the L-L direction and offset to the first imaginary central line M1 along the C-C direction. A first distance between the first imaginary central lines M1, M3 of adjacent first mating portions 71 of the signal contacts S along the C-C direction is not equal to a second distance between the second imaginary central lines M2, M4 of adjacent second mating portions 72 of the signal contacts S. The edge couple and the broad side couple have a different impact on the system. Therefore, the first and the second distances can be changed to keep the signal contacts S have continuity impendence. In this embodiment, the first distance is larger than the second distance.

Figure 8:
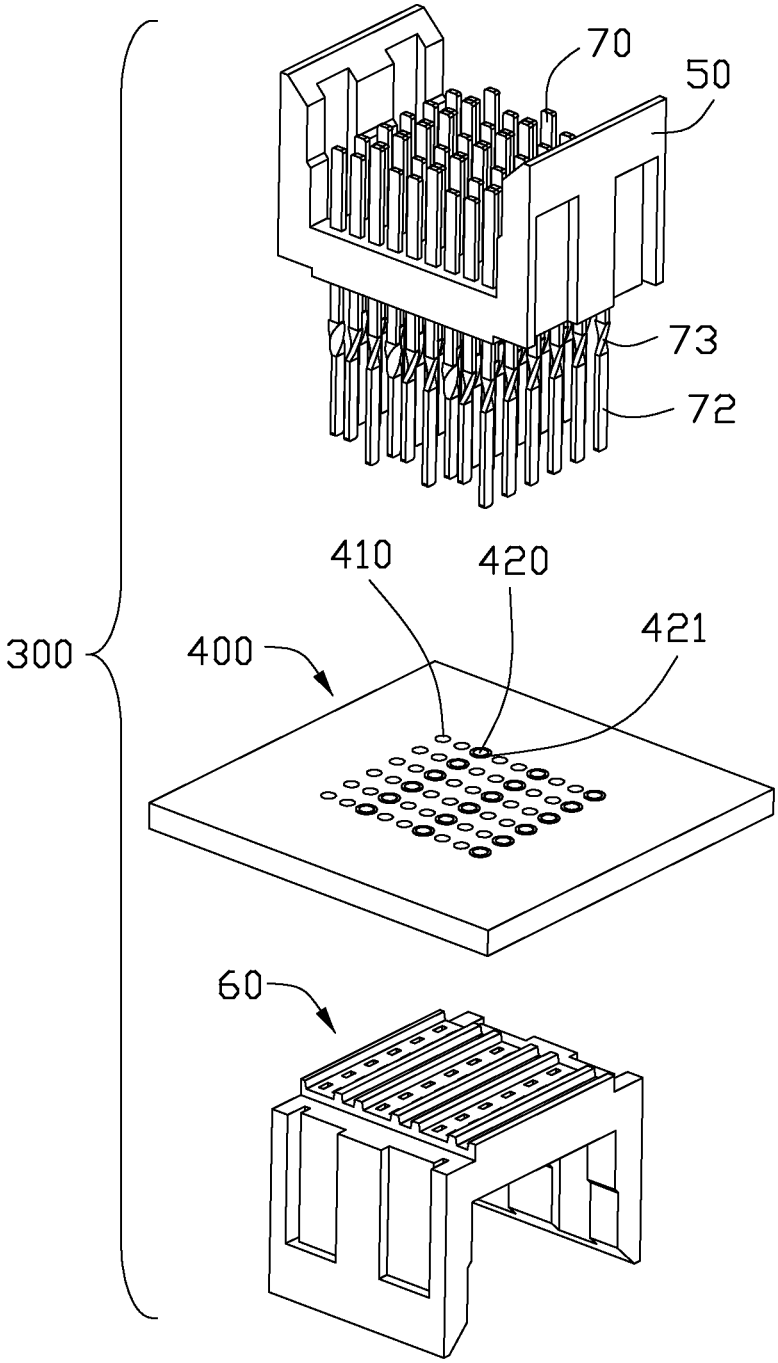
FIG. 8 is a partly exploded view of the electrical connector as shown in FIG. 7, further showing the first insulative housing separated apart from the middle board.

Referring to FIG. 8, the mounting holes 410 for receiving the signal contacts S don't coat any conductive material. Therefore, the signal contacts S could have continuity impendence. The mounting holes 420 for receiving the grounding contacts G have conductive layer 421 coated on the inner surface. Therefore, the grounding contacts G could have an improved grounding performance.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a middle board defining a plurality of receiving holes;

a first insulative housing mounted on a first surface of the middle board and defining a first receiving room having a first opening facing to a first direction;

a second insulative housing mounted on a opposite surface of the middle board and defining a second receiving room having a second opening facing to a second direction opposite to the first direction;

a plurality of contacts mounted on the first insulative housing, each contact comprising a first mating portion received in the first receiving room and a second mating portion received in the second receiving room, the first mating portion comprising a first mating surface for mating with a first mating connector, the second mating portion comprising a second mating surface for mating with a second mating connector, each of the contacts further comprising a twisted portion between the first and the second mating portions that make the first mating surface perpendicular to the second mating surface, the twisted portions received in the receiving holes respectively;

wherein the contact has a straight strip shape;

wherein each of the contacts comprises a mounting portion connecting with the twisted portion, the first mating portion extending from the mounting portion along the first direction, the second mating portion extending from the twisted portion along the second direction; and wherein the mounting portion has a first width, and the first and the second mating portions respectively have a width smaller than the first width.

2. The electrical connector as recited in claim 1, wherein the first insulative housing comprises a first mounting wall having a pair of opposite first edges, and a first side wall and a second side wall vertically extending from the first edges, respectively, the first receiving room being defined between the first side wall and the second side wall, the first mounting wall comprising a plurality of mounting holes for receiving the mounting portions, respectively.

3. The electrical connector as recited in claim 2, wherein the second insulative housing comprises a second mounting wall having a pair of opposite second edges, and a third side wall and a fourth side wall vertically extending from the second edges, respectively, the second receiving room being defined between the third side wall and the fourth side wall, the third and the fourth side walls being perpendicular to the first and the second side walls.

4. The electrical connector as recited in claim 3, wherein the first mounting wall is spaced apart from and parallel to the second mounting wall, and the twisted portions are disposed between the first and the second mounting walls.

5. The electrical connector as recited in claim 1, wherein the first mating surface comprises a first surface, a second surface opposite and parallel to the first surface, and a pair of first cut surfaces connecting between the first surface and the second surface; and the second mating surface comprises a third surface, a fourth surface opposite and parallel to the third surface, and a pair of second cut surfaces connecting between the third surface and the fourth surface, the first and the second cut surfaces having a surface roughness greater than a surface roughness of the first, the second, the third and the fourth surfaces.

6. An electrical connector comprising:

a middle board defining a plurality of receiving holes;

a first insulative housing mounted on a first surface of the middle board and defining a first receiving room for receiving a first mating connector;

a second insulative housing mounted on a opposite surface of the middle board and defining a second receiving room for receiving a second mating connector;

a plurality of contacts mounted on the first and the second insulative housings, each of the contacts comprising a first mating portion received in the first receiving room, a second mating portion received in the second receiving room, and a twisted portion between the first and second mating portions, each of the first mating portions comprising a first edge parallel to a row direction and having a first width, and a first broad side perpendicular to the first edge and having a second width greater than the first width, each of the second mating portions comprising a second broad side parallel to the row direction and having a third width, and a second edge perpendicular to the second broad side and having a fourth width less than the third width;

wherein the first edges are used for mating with the first mating connector, and the second broad sides are used for mating with the second mating connector;

wherein the contact has a straight strip shape; and wherein each of the contacts comprises a mounting portion connecting with the twisted portion, the first mating portion extending from the mounting portion along the first direction, the second mating portion extending from the twisted portion along the second direction.

7. An electrical connector comprising:

a printed circuit board defining thereof opposite first and second surfaces to form corresponding first and second receiving spaces thereon;

a plurality of through holes defined in the printed circuit board with rows and columns through both said first and second surfaces respectively;

a plurality of pin type contacts extending through the corresponding through holes, with opposite first and second ends disposed in the corresponding first and second receiving spaces, respectively, and each of said contacts defining a rectangular cross-section defined by two opposite smooth sides derived from an original sheet metal and two opposite rough sides derived from a stamping procedure under condition that said two opposite smooth sides are perpendicular to said two opposite rough sides;

wherein in the first receiving space, the smooth sides of said contacts are parallel to a first plane in the first receiving space while in the second receiving space the smooth sides of said contacts are parallel to a second plane perpendicular to said first plane;

wherein each of the contacts defines a middle twisting section between the first and second ends;

wherein said twisting section is received in the corresponding through hole; and wherein in each contact, a cross-section from the first end to the middle twisting section is not larger than that of the middle twisting section so as to allow the contact to be inserted into the corresponding through hole from the first end.

8. The electrical connector as claimed in claim 7, wherein a portion of the contact between the second end and the middle twisting section defines another cross-section larger than that of the middle twisting section.

9. The electrical connector as claimed in claim 7, wherein the smooth sides are longer than the rough sides.

* * * * *